United States Patent [19]

Schmittmann et al.

[11] Patent Number: 4,488,603

[45] Date of Patent: Dec. 18, 1984

[54] A COMPACT AND HIGHLY MOBILE FIRE-FIGHTING VEHICLE

[75] Inventors: Hans-Bernd Schmittmann, Velbert, Fed. Rep. of Germany; Samuel Müller, Wetzikon, Switzerland

[73] Assignee: Dr. H. Schmittmann GmbH, Fed. Rep. of Germany

[21] Appl. No.: 890,807

[22] Filed: Mar. 27, 1978

[30] Foreign Application Priority Data

Mar. 28, 1977 [CH] Switzerland ..... 3914/77
Jul. 21, 1977 [DE] Fed. Rep. of Germany ..... 2732886

[51] Int. Cl.[3] ..... A62C 27/16

[52] U.S. Cl. ..... 169/24; 169/52; 169/54; 239/172

[58] Field of Search ..... 169/24, 25, 52, 47, 169/64, 54, 69; 239/172, 175; 180/65 F, 68.5; 280/269, 280

[56] References Cited

U.S. PATENT DOCUMENTS

| | | | |
|---|---|---|---|
| 1,261,100 | 4/1918 | Clarke | 169/24 |
| 1,421,496 | 7/1922 | Klewanech | 169/24 |
| 1,593,194 | 7/1926 | Scott | 180/65 F |
| 1,732,274 | 10/1929 | Livingston | 169/24 |
| 2,577,457 | 12/1951 | Freeman | 169/24 X |
| 3,003,573 | 10/1961 | Lorenz | 180/68.5 |
| 3,155,319 | 11/1964 | Hammelmann | 169/24 X |
| 3,724,554 | 4/1973 | Rupert et al. | 169/52 |
| 3,762,478 | 10/1973 | Cummins | 169/25 X |
| 4,037,664 | 7/1977 | Gibson | 239/172 X |

FOREIGN PATENT DOCUMENTS

| | | | |
|---|---|---|---|
| 57349 | 12/1936 | Norway | 180/65 F |
| 998490 | 7/1965 | United Kingdom | 169/15 |
| 1191449 | 5/1970 | United Kingdom | 169/24 |

*Primary Examiner*—Charles A. Marmor
*Attorney, Agent, or Firm*—Wigman & Cohen

[57] ABSTRACT

A compact and highly mobile fire-fighting vehicle is disclosed which is capable of entering buildings through doorways and being maneuvered through corridors to the location of the fire. The vehicle carries fire extinguishing materials thereon and a spray device for spraying such materials. The vehicle can be battery operated directly by an operator or by an electronic remote control device provided on the chassis. A plurality of vehicles of the present invention can be effectively utilized to surround and isolate a fire.

19 Claims, 4 Drawing Figures

A COMPACT AND HIGHLY MOBILE FIRE-FIGHTING VEHICLE

BACKGROUND OF THE INVENTION

The invention relates to a fire-fighting vehicle having a small and compact construction.

Various devices and apparatuses are known for fighting fires. These known devices can be divided into four groups. The first group includes portable devices for fighting beginning fires and contain up to 12 kg of extinguishing material in the form of powder, foam, Halon or water. The second group includes push-devices which are employed in fighting beginning and small fires and contain up to 50 kg of powder or foam extinguishing material. Pull-devices represent the third group. These devices are embodied as trailers, carry up to 250 kg of powder or foam extinguishing material and are employed in fighting small and medium size fires. The fourth group includes fire-fighting vehicles embodied as trucks with special superstructures. These vehicles carry 500 or more kg of fire extinguishing material. They generally carry a wide assortment of fire-fighting equipment, such as pumps, hoses and the like. They are manned by several men and are employed in fighting large fires.

An obvious gap exists between the known groups of the above-mentioned prior art. This becomes especially noticeable when one observes that the smaller devices carry only one extinguishing material, foam, powder or water and are therefore not suitable for use alone against multiple material fires. Persons skilled in the art also doubt the handling capabilities of devices carrying as little as 12 kg of extinguishing material. With the larger devices in the third and especially the fourth groups a fire-fighting crew is generally necessary.

OBJECTS AND SUMMARY OF THE INVENTION

The object of the invention is to close this gap. Accordingly, the basic object of the invention is to create a fire-fighting vehicle having a small and compact construction which can be employed in fighting fires, especially in high-rise apartment buildings, factories, warehouses and the like, which can be driven through normal door openings, and narrow curves, carries single or multiple extinguishing materials available in combination in different containers, and can be operated by a single servicing person.

To carry out this objective, the invention provides a self-propelled small, compact fire-fighting vehicle which can be steered, has space for at least one servicing person and has at least one and preferably several containers carrying various fire extinguishing materials as well as a connection for indirect and direct water supply. With this type of fire-fighting vehicle according to the invention, fires of the most varying types can be effectively fought, especially in locations where known fire-fighting equipment cannot be effectively utilized because of insufficient extinguishing capacity or because of its limited maneuverability. The fire-fighting vehicle, according to the invention, is especially well suited for fighting fires in high-rise apartment buildings or other buildings, factories, warehouses and the like. Due to the small, compact construction, the fire-fighting vehicle of this invention can be transported in freight or regular elevators, driven through corridors and door openings and moved directly to the location of the fire. Additionally, several fire-fighting vehicles of the present invention can be effectively utilized to fight a fire, so that the fire can be encircled and quickly and effectively fought. An additional noteworthy advantage is that the fire-fighting vehicle according to the invention has a connection to a source of external extinguishing material in addition to its own supply of extinguishing material. Thus, the external supply of fire extinguishing material can be used after all of the carried extinguishing material is exhausted. The external supply of fire extinguishing material can emanate from a hydrant or from a follow-up fire-fighting vehicle by means of hose lines that are equipped with adapters.

To optimize effectiveness, the fire-fighting vehicle of this invention possesses a low-body chassis which is supported by four wheels and which supports one or more superstructures placed thereon. It can be steered directly or by conventional remote control systems, and is preferably driven by a pair of battery-powered electric motors which act on the rear wheels. The batteries are housed in one of the superstructures, preferably in a manner which results in as low a center of gravity of the vehicle as is possible. The low center of gravity of the fire-fighting vehicle permits the vehicle to be driven at a relatively high speed.

By means of the invention, a compact, self-propelled miniature fire-fighting vehicle is provided with which it is possible to drive into practically any room, through narrow corridors or alleys and around tight corners, and which can carry a substantial supply of extinguishing material in order to effectively fight small and medium-sized fires, alone or in combination with other such vehicles. However, the fire-fighting vehicle according to the invention is also equipped to be able to be employed in combination with large fire-fighting vehicles for fighting large fires, whereby it can be operated by one man. The invention offers a completely new fire-fighting tactic, that is, employing a plurality of fire-fighting vehicles en masse, which, when connected to a relatively immobile large tank vehicle, can encircle a fire to fight it simultaneously from several sides while being controlled from a central location.

Additional important characteristics and constructive embodiments of the invention are described in dependent claims 6 through 24.

BRIEF DESCRIPTION OF THE DRAWINGS

The invention is described below in greater detail with the aid of an exemplary embodiment shown in the drawings. Shown are:

The fire-fighting vehicle 1 has a small and compact construction, which includes a self-contained drive acting on wheels 2, steering means and its own supply of extinguishing material. The fire-fighting vehicle 1 consists of a chassis 3 with a rear superstructure 4, which at least includes a tank 5 containing fire extinguishing material and a concentrate tank 6. In addition, on the front end of chassis 3 sits a superstructure 7 having low box-like drawers 8 to receive batteries 9. Above the drawers 8 there is a box-like structure 10 for housing an electronic remote-control unit (not shown in detail) and other equipment as, for example, a charging device for the batteries 9. Suitable chambers for storing tools or the like can be provided in the drawers 8 and/or the structure 10, said drawers being easily accessible from the sides. The box-like structure 10 is defined on its upper side by a control panel 11 which includes operating elements 12 and a radio-telephone apparatus (not shown). As seen in FIG. 3, column 13 extends through the superstructure 7 and supports steering means 14 at its upper end. The bottom end of steering column 13 connects with steering members 15. In this manner the steering deflection of the steering means 14 is transferred to the front wheels. An approximately vertical tubular member or conduit 16 (FIG. 1) extends through the front superstructure 7 and includes an upper flange 17 which supports an abutting flange 18 carrying a spray unit. The spray unit can be adjusted by a handle 19 and includes a water nozzle 20 and a foam cannon 21. The water nozzle 20 and the foam cannon 21 are arranged so as to be interchangeable and are placed into operation by manual valves 22. For reaching remote or inaccessible locations, a hose line can be substituted for the water nozzle 20.

The conduit 16 is in effect extended by conduit 23 at its lower end. Conduit 23 is advantageously positioned beneath the floor of the vehicle and extends in the longitudinal direction of the chassis 3 beyond the rear end of the vehicle, where an adapter 24 is provided for connection to hose lines. By means of the adapter 24 the fire-fighting vehicle can be supplied with external extinguishing material, e.g., from a hydrant or from a large fire-fighting vehicle.

Figure 1:
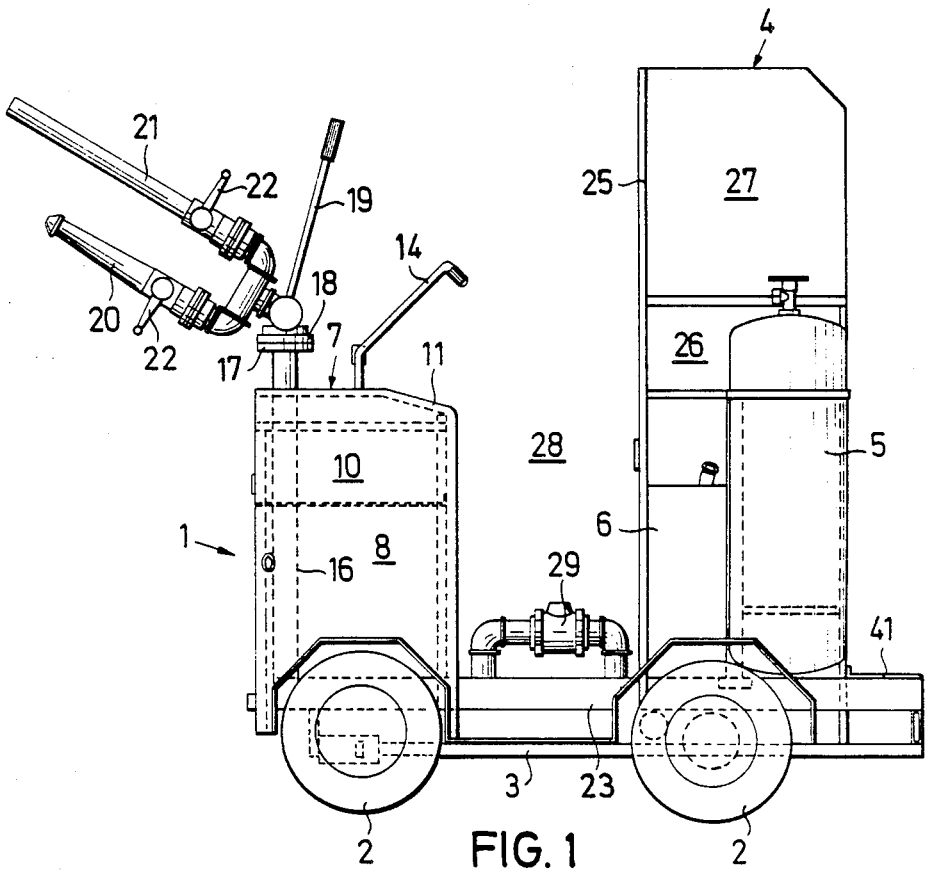
FIG. 1 is a view of the fire-fighting vehicle of the present invention.
Figure 2:
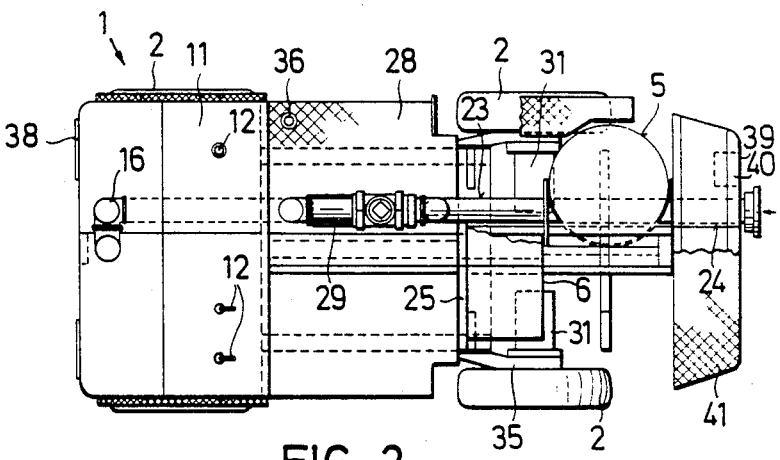
FIG. 2 is a top view of the fire-fighting vehicle of the present invention.
Figure 3:
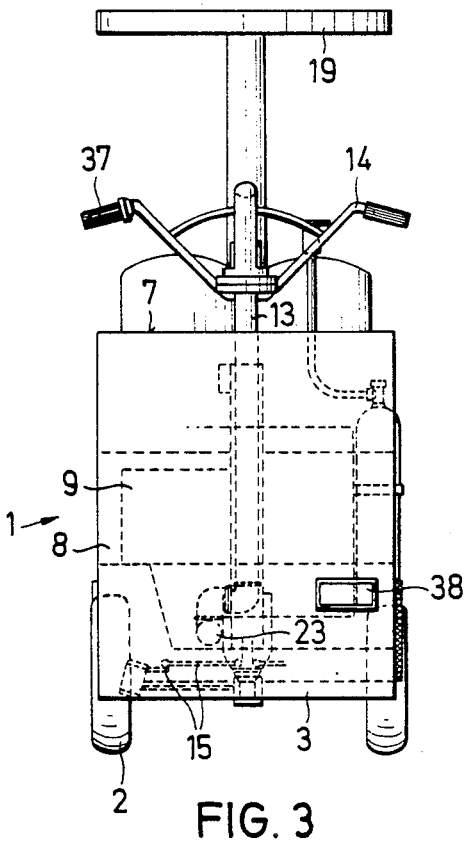
FIG. 3 is the front view of a fire-fighting vehicle of the present invention.
Figure 4:
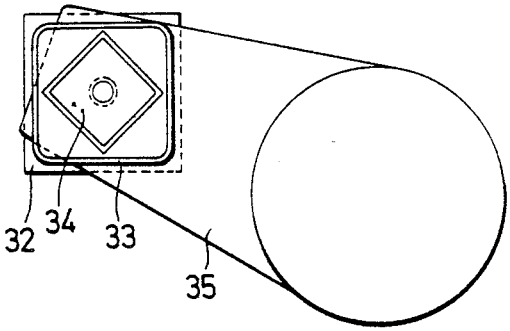
FIG. 4 is a detailed view which illustrates the suspension of a single wheel.

The rear superstructure 4 is closed on its inner side by a back support 25. The back support 25 further defines chambers 26, 27, which serve to house rescue equipment, breaking material and the like. A platform 28 is provided between the rear superstructure 4 and the front superstructure 7, in which an additive mixer 29 is arranged near the floor. The additive mixer 29 is connected with the pipe 23 and the concentrate tank 6 whereby the extinguishing water entering the adapter can be enriched with concentrate. The additive mixer 29 can also effectively be arranged beneath the floor, so that the operator obtains a greater freedom of movement. Platform 28 serves to support the driver responsible for the operation of the fire-fighting vehicle during its operation. A seat arrangement (not shown) can also be provided. The fire-fighting vehicle is preferably driven by two electric motors 31, which draw their current from the batteries 9. The motors 31 act directly on the rear wheels 2, the axle shafts being formed in one piece with their respective motor shafts. Each of the rear wheels 2 possesses an individual wheel suspension as shown in FIG. 4. A box pipe 32 is welded onto the chassis 3, and a spring element 33 arranged therein is connected with a quadratic pin 34, which, in turn, supports a bracket arm 35. One of the electric motors 31 is attached to a flat side of the bracket arm 35 and one of the rear wheels 2 sits on the other side.

A foot brake pedal 36 projects out of the standing platform 28. Additionally, the fire-fighting vehicle is equipped with a hand-operated brake (not shown). The steering means 14 possesses a rotating grip 37 for regulating the speed. A foot pedal lever can also be provided for this purpose.

The fire-fighting vehicle 1 also includes illumination apparatus, e.g., headlights 38, flashing lights 39, tail and brake lights 40, and a search light (not shown). Also provided on the rear end of the chassis is folding step plate 41 and a trailer hitch (not shown).

In accordance with the present invention, the front and rear wheels can be provided with air filled tires, or solid rubber tires, or can be formed as track wheels.

The fire fighting vehicle of the present invention has a maximal width of about 100 cm and a length of about 130 cm. The vehicle tank means for storing fire-extinguishing materials and concentrate has a capacity of from 50 to 250 kg.

Although only a preferred embodiment is specifically illustrated and described herein, it will be appreciated that many modifications and variations of the present invention are possible in light of the above teachings and within the purview of the appended claims without departing from the spirit and intended scope of the invention.

We claim:

1. A fire-fighting vehicle having a small and compact construction which allows passage through a standard building door opening, hall corridors, or the like, comprising:

a movable chassis which is relatively low and is supported by a plurality of wheels for transporting said vehicle; means carried by said chassis for independently fighting a variety of fires without attachment to an external source of water;

means for self-propulsion supported by said chassis, said self-propulsion means including an electric motor operatively connected to at least one of said wheels, battery means electrically connected to said electric motor;

a front and rear superstructure arranged on said chassis and a connecting platform therebetween for carrying an operator;

said front superstructure including spray means for spraying fire extinguishing material;

said rear superstructure carrying tank means for storing fire extinguishing materials;

steering means operatively connected with said wheels for directing said vehicle to a fire-fighting location;

connection means for indirectly or directly introducing an external supply of water to said vehicle; and front and rear wheels supporting said chassis;

said front and rear superstructures supported over said front and rear wheels respectively;

wherein said platform means terminates at an upstanding back support, said back support constituting one wall of a storage compartment for recovery equipment, a concentrate tank located below said storage compartment and in at least close proximity to said tank means which contains foam or powder extinguishing material.

2. The fire-fighting vehicle according to claim 1 wherein said steering means includes a steering bar for manual operation.

3. The fire-fighting vehicle according to claim 1 wherein said steering means is remotely controlled.

4. The fire-fighting vehicle according to claim 1 further including an electric motor for driving each of said rear wheels, each of said rear wheels having an axle shaft which is connected to the shaft of said electric motor.

5. The fire-fighting vehicle according to claim 4 wherein said rear wheels are individually suspended.

6. The fire-fighting vehicle according to claim 4 wherein said front and rear wheels are equipped with air-filled tires.

7. The fire-fighting vehicle according to claim 1 wherein said front superstructure has side-accessible drawers for receiving batteries therein and for housing said steering means, said spray unit being supported on said superstructure.

8. The fire-fighting vehicle according to claim 1 further including a conduit between said spray means and said tank means arranged beneath the floor of the chassis.

9. The fire-fighting vehicle according to claim 1 further including an additive mixer and a concentrate tank.

10. The fire-fighting vehicle according to claim 1 wherein said tank means has a capacity of from 50 to 250 kg of fire extinguishing material and concentrate.

11. The fire-fighting vehicle according to claim 1 further including a remote control electronic system, installed in said superstructure, said remote control electronic system being adapted for steering and for controlling the fire-fighting operations of said vehicle.

12. The fire-fighting vehicle according to claim 1 further including an illuminating means such as headlights, search lights, flashing lights, tail lights and brake lights.

13. The fire-fighting vehicle according to claim 1 further including brake means comprising a foot pedal lever and a hand brake for controlling the movement of said vehicle.

14. The fire-fighting vehicle according to claim 1 wherein a foldably mounted seat for the operator is arranged on the front side of the back rest.

15. The fire-fighting vehicle according to claim 1 further including a foldable step board arranged on the rear end of the chassis.

16. The fire-fighting vehicle according to claim 1 further including a trailer hitch arranged on the rear end of the chassis.

17. The fire-fighting vehicle according to claim 1 wherein said vehicle has a maximal width of about 100 cm and a length of about 130 cm.

18. The fire-fighting vehicle according to claim 4 wherein said front and rear wheels are equipped with solid rubber tires.

19. The fire-fighting vehicle according to claim 1 wherein said front and rear wheels are formed as track wheels.

* * * * *